United States Patent [19]

Cook, Jr.

[11] 4,285,795

[45] Aug. 25, 1981

[54] ELECTROLYSIS APPARATUS

[75] Inventor: Edward H. Cook, Jr., Lewiston, N.Y.

[73] Assignee: Hooker Chemicals & Plastics Corp., Niagara Falls, N.Y.

[21] Appl. No.: 569,521

[22] Filed: Apr. 18, 1975

Related U.S. Application Data

[63] Continuation-in-part of Ser. No. 387,098, Aug. 9, 1973, which is a continuation-in-part of Ser. No. 212,171, Dec. 27, 1971.

[51] Int. Cl.[3] ..... C25B 9/00; C25B 13/08

[52] U.S. Cl. ..... 204/266; 204/296

[58] Field of Search ..... 204/296, 266, 128, 98

[56] References Cited

U.S. PATENT DOCUMENTS

| | | | |
|---|---|---|---|
| 2,681,320 | 6/1954 | Bodamer | 204/98 |
| 2,967,807 | 1/1961 | Osborne et al. | 204/98 |
| 3,247,133 | 4/1966 | Chen | 204/296 X |
| 3,257,334 | 6/1966 | Chen et al. | 204/296 X |
| 3,282,875 | 11/1966 | Connolly et al. | 260/29.6 |
| 3,403,083 | 9/1968 | Currey et al. | 204/337 |
| 3,481,847 | 12/1969 | Hine et al. | 204/128 |
| 3,853,721 | 12/1974 | Darlington et al. | 204/296 |

OTHER PUBLICATIONS

"XR Perfluorosulfonic Acid Membranes", New Product Information, E. I. Du Pont de Nemours & Co. (Inc.), Oct. 1, 1969, pp. 1–4.

*Primary Examiner*—R. L. Andrews

*Attorney, Agent, or Firm*—Howard M. Ellis

[57] ABSTRACT

An improved apparatus for the electrolysis of aqueous solutions of ionizable chemical compounds is disclosed including specifically an apparatus for the production of chlorine and caustic containing low concentrations of sodium chloride by the electrolysis of brine which comprises electrolyzing brine solutions in a cell equipped with a cathode and an anode separated by a cation-active permselective diaphragm.

4 Claims, 1 Drawing Figure

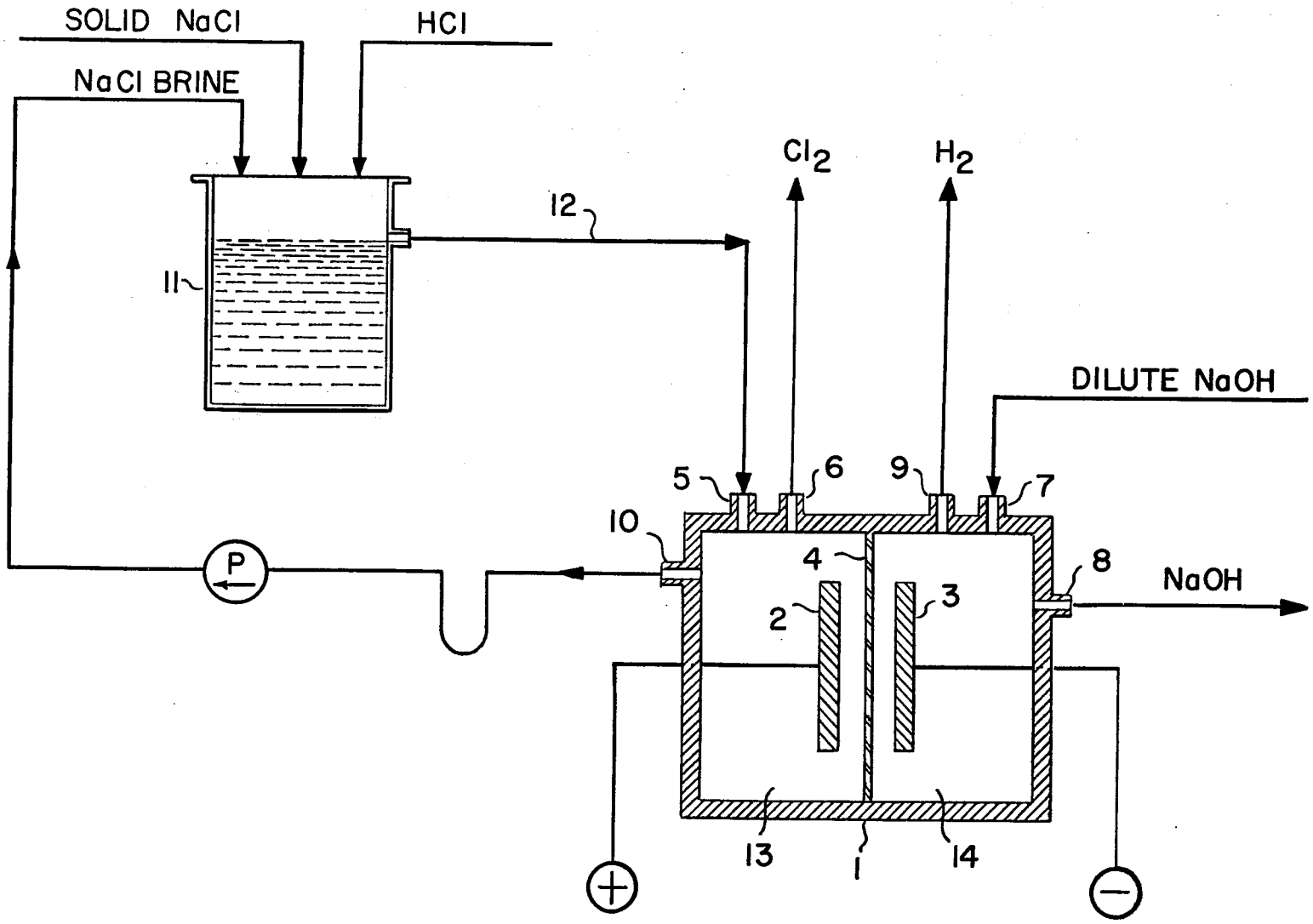
DILUTE NaOH
NaOH
H2
Cl2
HCl
SOLID NaCl
NaCl BRINE
1
2
3
4
5
6
7
8
9
10
11
12
13
14
P

ELECTROLYSIS APPARATUS

CROSS REFERENCE TO RELATED APPLICATIONS

This application is a continuation-in-part of U.S. application Ser. No. 387,098, filed Aug. 9, 1973, which in turn is a continuation-in-part of U.S. application Ser. No. 212,171 filed Dec. 27, 1971.

BACKGROUND OF THE INVENTION

This invention relates to improved apparatus for the electrolysis of aqueous solutions of ionizable chemical compounds. More particularly it relates to the production of halogens, e.g., chlorine, and alkali metal hydroxides, e.g., sodium hydroxide, in an electrolytic cell which possesses advantages over previously known cells.

The electrolysis of aqueous solutions of ionizable chemical compounds, particularly brine solutions, in a cell equipped with an anode and a cathode separated by a porous diaphragm is well known in this art. In most instances such cells are operated under conditions such that ionic migration and molecular migration through the porous diaphragm occurs to a substantial degree resulting in the contamination of the cathode liquor with undecomposed electrolyte and of the anode liquor with reaction products of the cathodic material and anodic materials.

Presently, there is a high demand for pure aqueous caustic for use in commercial processes. For example, in the production of rayon or pharmaceuticals, the caustic must contain less than 100 ppm chloride ion, i.e. less than 0.1% chloride ion. In addition, a great many other commercial processes require caustic containing less than 1000 ppm chloride ion, i.e. less than 1.0% chloride ion.

In one prior art process, pure caustic is obtained by electrolysis of brine floating on a mercury cathode to form chlorine gas and a mercury-sodium complex. The complex then is contacted with water to form caustic, mercury and hydrogen gas. The caustic has good purity in that it is free from chloride ion but is impure in that it is contaminated with mercury. This mercury contamination has severly limited the use of the caustic, particularly in the production of pharmaceuticals.

As a substitute from the above-described process, it has been proposed to conduct the electrolysis of brine solutions in a cell wherein the anode and cathode are separated by a fluid-permeable diaphragm such as an asbestos diaphragm to evolve chlorine gas from the anode compartment and caustic from the cathode compartment.

The sodium hydroxide produced by this method is, however, relatively dilute and, because of the fluid permeable nature of the diaphragms used, it is further contaminated with various impurities, such as sodium chloride, sodium chlorate, iron and the like. It is, therefore, necessary to subject the sodium hydroxide product to various evaporation steps and purification steps such as liquid-liquid extraction with ammonia in order to obtain a product which is suitable for many commercial uses, particularly those requiring less than about 1% chloride ion. Moreover, with such electrolytic cells, there is an appreciable back migration of hydroxyl ions from the cathode compartment to the anode compartment which results in the production of hypochlorites which are oxidized to chlorates, with a consequent reduction in chlorine yield and further contamination of the sodium hydroxide. Additionally, depending upon the source of sodium chloride used in making up the brine electrolyte, brine purification systems must frequently be used to eliminate ions such as calcium, that may clog the fluid permeable diaphragms. While these processes are desirable from the standpoint that chloride-free caustic can be obtained, these same processes are undesirable because of the cost of conducting the manipulative steps subsequent to electrolysis.

Attempts have heretofore been made to overcome the aforesaid difficulties in the operation of such diaphragm cells by replacing the fluid permeable asbestos diaphragms with permselective ion exchange membranes. In theory, the use of such membranes which, for example, would permit the passage of only sodium ions from the anode compartment to the cathode compartment, would eliminate the problems of contamination of the sodium hydroxide liquor in the cathode compartment and would prevent the back migration of hydroxyl ions to the anode compartment to thereby reduce hypochlorite and chlorate formation therein. For this purpose, various resins, such as cation exchange resins of the "Amberlite" type, sulfonated copolymers of styrene and divinylbenzene, and the like, have been proposed including those disclosed in U.S. Pat. No. 2,967,807, U.S. Pat. No. 3,390,055 and French Pat. No. 1,510,265. In practice, however, the permselective ion exchange membranes which have been used have generally been found not to be stable to the strong caustic and/or acidic solutions encountered in the cells at operating temperatures above 75 degrees C. so that they have had only a relatively short effective life in the order of only up to about 45 days. Additionally, as the concentration of caustic soda in the catholyte liquor is increased, e.g. above about 200 grams per liter, it has frequently been found that the ion selectivity and chemical compatibility of the membrane decreases, the voltage drop through the membrane becomes unacceptably high and the caustic efficiency of the electrolysis process decreases. These undesirable characteristics of the membrane result in increased costs associated with membrane replacement and cell down-time. It is believed that the poor membrane life observed is caused by chemical attack by chloride ion and/or hypochlorite ion on the membrane or on the functional groups of the membrane. When these functional groups are removed or chemically altered, the selectivity of the membrane for passage therethrough of sodium cation is substantially reduced.

Thus, it has been observed that even membranes known to be resistant to caustic and chloride ion do not exhibit good useful lives in the electroysis cell since the membranes are not resistant to hypochlorite ion. Accordingly, it would be highly desirable to provide an electroysis cell for forming pure caustic from brine which eliminates the need for either a caustic evaporation step or a caustic-extraction treatment step in order to obtain caustic having less than 1% or 0.1% chloride ion. Furthermore, it would be highly desirable to provide such a process having a permselective membrane within the cell wherein the useful life of the membrane is extended significantly beyond the useful life of presently available permselective membranes. Such a process would significantly reduce the cost of producing pure caustic from the standpoint of eliminating manipulative process steps, reducing cell down-time and reducing membrane useage.

OBJECTS OF THE INVENTION

It is thus a primary object of this invention to provide a novel electrolysis apparatus which overcomes the difficulties inherent in the prior art methods encountered in segregating the desirable products during the electrolytic decomposition of chemical compounds in electrolytic cells of the diaphragm type without loss of the many advantages inherently connected therewith.

It is another object to devise apparatus utilizing as the diaphragm a material which precludes or substantially reduces both molecular migration and undesirable ionic migration but which still permits the conduction of electric current by movement of desirable ions.

It is a particular object to devise an electrolytic cell employing a diaphragm material for the cell which will give high purity products in high yield without undue loss of electrical current and loss of product yield due to ionic and/or molecular migration.

A further object is to devise an electrolytic cell employing a cation-active permselective material as the diaphragm which can be operated with high current efficiency for long periods without destruction of the diaphragm.

Other objects and advantages will be apparent to those skilled in this art on consideration of this specification and the appended claims.

SUMMARY OF THE INVENTION

The objects and advantages of this invention are accomplished by providing an electrolytic cell for carrying out the electrolysis of an aqueous solution of an ionizable chemical compound said cell comprising a housing, an anode, a cathode, a cation-active permselective diaphragm substantially impervious to liquids and gases separating said anode and said cathode and thereby forming an anode compartment and a cathode compartment, said anode compartment having a liquid inlet, a liquid outlet, and an outlet for gaseous products formed at the anode, and said cathode compartment containing a liquid inlet, a liquid outlet and an outlet for the gaseous products formed at the cathode.

The cation-active permselective diaphragm should be inert with respect to the electrolyte and the products of the electrolysis. The material forming the diaphragm, barrier or septum employed in the apparatus of this invention is radically different from any previously known or used material in that it retains its effectiveness, that is, inertness to the electrolyte and products of the electrolysis, over extended periods of operation of at least about one order of magnitude longer than membranes presently available for this purpose.

DETAILED DESCRIPTION OF THE INVENTION

In order that the invention may be more readily understood, it will be described with specific reference to certain preferred embodiments, and specially with reference to the apparatus suitable for the electrolysis of an aqueous solution of sodium chloride whereby chlorine, caustic soda, and hydrogen are produced. It, however, is not to be construed as limited thereto except as defined in the appended claims.

In accordance with a preferred mode of carrying out the invention, an aqueous solution of sodium chloride is electrolyzed in a chlor-alkali cell comprised of a vessel divided into an anode compartment containing an anode and a cathode compartment containing a cathode, the compartments being separated by a diaphragm substantially impervious to fluids and gases and being composed essentially of a hydrolyzed co-polymer of tetrafluoroethylene and a sulfonated perfluorovinyl ether having the formula $$FSO_2CF_2CF_2OCF(CF_3)CF_2OCF{=}CF_2$$

said co-polymer having an equivalent weight of from about 900 to 1600. Preferably the equivalent weight of the co-polymer is from about 1100 to 1400.

Co-polymers of the character referred to above are prepared as disclosed in U.S. Pat. No. 3,282,875, by reacting, at a temperature below about 110 degrees centigrade a perfluorovinyl ether of the formula $$FSO_2CF_2CF_2OCF(CF_3)CF_2OCF{=}CF_2$$

with tetrafluoroethylene in an aqueous liquid phase, preferably at a pH below 8, and in the presence of a free radical initiator such as ammonium persulfate, and subsequently hydrolyzing the acyl fluoride groups to the free acid or salt form by conventional means.

Unexpectably, it has been found that diaphragms formed from this copolymers promote the formation of pure caustic containing less than about 0.1% chloride ion directly from the cell without the need for additional caustic purification steps. Furthermore, it has been found that the useful life of these diaphragms is at least one order of magnitude longer than the membranes presently available for this purpose. Specifically, it has been found that diaphragms formed from these copolymers have a useful life in these cells of about 650 days or more. It is believed that these membranes are not only resistant to chlorine and caustic, but, unlike presently available membranes, are highly resistant to hypochlorite ion.

The apparatus of this invention will be further described with reference to the attached drawing which shows a schematic view of the electrolytic cell, 1, comprising an anode, 2, and a cathode, 3, separated by a cation-active permselective membrane diaphragm, 4, to form an anolyte compartment, 13 and a catholyte compartment, 14. The cell, 1, has an inlet, 5, in the anode compartment, 13, for the electrolyte, and outlet, 10, for spent electrolyte and an outlet, 6, for chlorine gas. There is also provided an inlet, 7, for charging liquids, such as a dilute aqueous caustic soda, to the cathode compartment, 14, an outlet, 8, for discharging NaOH liquor from the cathode compartment, and an outlet 9, for gas, such as hydrogen gas.

Saturated brine is continuously circulated in the anolyte compartment 13, by introducing brine through inlet 5 and withdrawing it through the outlet for overflow, 10, to the replenishing zone, 11, where the brine is resaturated with sodium chloride and acidified with acid, if desired. The replenished electrolyte flows, via line 12, to reenter cell 1, at inlet 5.

Dilute aqueous liquor, such as aqueous caustic soda is charged to the cathode compartment through liquid inlet, 7, and is discharged from the cathode compartment through liquid outlet, 8. Thereby the aqueous liquor is concentrated with respect to the product formed at the cathode, e.g., caustic soda, and the discharged liquor is directed to a suitable recovery means for concentration and separation of the desired product, e.g., concentrated caustic soda. Additional dilute aqueous liquor is charged to the cathode compartment which together with the water which passes through the diaphragm by osmosis serves as make up for the catholyte. Gaseous products e.g., hydrogen formed at the cathode are discharged from the cell through gaseous outlet, 9.

In the preferred embodiment, sodium chloride brine solutions containing from about 200 gpl to 320 gpl sodium chloride are electrolyzed in cells having an anode compartment and a cathode compartment separated by a homogeneous cation active membrane formed from a copolymer of the type described above which copolymer is substantially impervious to gases and liquids, by impressing a decomposition voltage across the electrodes disposed in each of said compartments, while maintaining the alkali metal hydroxide content in said cathode compartment above about 10% by weight, and preferably from about 24 to about 33 percent by weight, and recovering an alkali metal hydroxide product from said cathode compartment containing less than about one percent by weight of sodium chloride, and chlorine from said anolyte compartment.

The present invention has the desirable advantage over many prior art electrolysis cells and processes, in that the cell, is readily converted for use for the electrolysis of hydrochloric acid to produce chlorine and hydrogen, the latter being obtained substantially free from chlorine. Thus the cells of this invention can be readily and economically modified for use to electrolyze either brine or hydrochloric acid, as the demand warrants. Accordingly, it is a feature of this invention that it can be efficiently operated to produce chlorine at high, e.g. about 99 percent anode efficiency, and high purity caustic soda or high purity hydrogen gas as principal products.

It is preferred when operating the cell for the electrolysis of brine, to use acidified brine as the feed to the anolyte compartment. The addition of hydrochloric acid to the brine feed has been found to reduce the tendency of hydroxyl ions to migrate from the catholyte to the anolyte and also to neutralize such hydroxyl ions as do so migrate. The amount of acid used to acidify the brine feed can be varied over a broad range. In general the brine feed may contain from two to ten percent by weight of hydrochloric acid and preferably from about three to about seven percent by weight can be used. By the addition of acid to the brine feed, the pH of the anolyte may be varied over a broad range also. Preferably the anolyte liquor should have a pH in the range of about 1 to 5 and especially within the range of about 2.5 to 4.0. The maintenance of a pH within the ranges set out above in the anolyte compartment, by reducing the hydroxyl ion concentration in the anolyte, reduces the formation of sodium chlorate in the anolyte. Thus the lower the pH in the anolyte, the less sodium chlorate is formed in the anolyte and consequently the higher the efficiency of the cell.

In the preferred operation of the cell for the electrolysis of hydrochloric acid, the feed to the anode compartment is an aqueous hydrochloric acid solution, desirably having an HCl content of from about 10% to 36% by weight and preferably of from about 15% to 25%. The feed to the cathode compartment may be water, although desirably it is also an aqueous hydrochloric acid solution having an HCl content of from about 1% to 10% by weight with from about 1% to 5%, being preferred. The feed to both the anode and cathode compartments should be free of alkali metal, or other contaminating ions, although, when a steel or other corrodible cathode is used, alkali metal chlorides may be added to the anode compartment feed to minimize corrosion. Where such additions are used, amounts of the alkali metal chloride, e.g. NaCl, within the range of about 1 to 26% by weight of the anolyte are typical.

In general, the process utilizing the electrolytic cell of the present invention, whether using a brine or hydrochloric acid feed, may be operated over a wide temperature range, e.g. from room temperature up to the boiling point of the electrolyte, although temperatures of from about 65° to 90° C. are preferred. Similarly, a wide variation in the electrical operating conditions is also possible. Thus, for example, cell voltages of from about 2.3 to 5 volts and anode current densities of from about 0.5 to 4 amps/in$^2$ are suitable.

The housing or outer casing member and cover of the electrolytic cell is formed of any electrolytically nonconductive material which is resistant to chlorine, hydrochloric acid and caustic alkali and which will withstand the temperatures at which the cell may be operated. Generally, as has been indicated, these temperatures are preferably from about 65 to 95 degrees centigrade. Exemplary of the materials which may be used are high temperature polyvinyl chloride, hard rubber, chlorendic acid based polyester resins, and the like. It will be appreciated that the materials of construction for this housing member preferably have sufficient rigidity as to be self-supporting. Alternatively, however, the housing may be formed of such material which does not fulfill all the above mentioned criteria, such as concrete or cement, which materials are not resistant to hydrochloric acid and chlorine, and have the interior exposed areas of such members coated with a material which does fulfill these requirements. Additionally, even in the case of materials which are substantially self-supporting, such as rigid polyvinyl chloride, it is desirable on occasion such as in the instance of relatively large installations to provide reinforcing members around the exterior of the member, such as metal bands, to provide additional rigidity.

The electrodes for the electrolytic cell of this invention can be formed of any electrically conductive material which will resist the attack of caustic alkali, hydrochloric acid and chlorine. In general, the cathodes are constructed from graphite, iron or steel although any resistant material can be used. The anodes may be formed from graphite or metallic substances such as platinized titanium covered steel or aluminum structures or other dimensionally stable metal structures.

The diaphragm material used in the apparatus of this invention consists essentially of at least one cationactive permselective material selected from the group consisting of a hydrolyzed copolymer of a perfluorinated hydrocarbon and a fluorosulfonated perfluorovinyl ether and of a sulfostyrenated perfluorinated ethylene propylene polymer.

In a preferred embodiment of this invention the cationactive permselective membranes are composed essentially of co-polymers of tetrafluoroethylene and a sulfonated perfluorovinylether having the formula $$FSO_2CF_2CF_2OCF(CF_3)CF_2OCF{=}CF_2$$

said copolymer having an equivalent weight of from about 900 to about 1600. Preferably the equivalent weight of the copolymer is in the range of from about 1100 to about 1400.

Co-polymers of the character referred to above are prepared as disclosed in U.S. Pat. No. 3,282,875, by reacting, at a temperature below about 110 degrees centigrade a perfluorovinylether of the formula $$FSO_2CF_2CF_2OCF(CF_3)CF_2OCF{=}CF_2$$

with tetrafluoroethylene in an aqueous liquid phase, preferably at a pH of 8 or below, and in the presence of a free radical initiator such as ammonium persulfate. Subsequently this fluorosulfonated co-polymer is hydrolyzed to the free acid or salt formed by conventional means.

Thus, the presently preferred cation selective membrane material is of a hydrolyzed copolymer of a perfluorinated hydrocarbon and a fluorosulfonated perfluorovinyl ether. The perfluorinated hydrocarbon is preferably tetrafluoroethylene although other perfluorinated saturated and unsaturated hydrocarbons of from 2 to 5 carbon atoms can also be utilized, of which the monoolefinic hydrocarbons are preferred, especially those of 2 to 4 carbon atoms and most especially those of 2 to 3 carbon atoms, e.g., tetrafluoroethylene, and hexafluoropropylene. The sulfonated perfluorovinyl ether which is most useful is that of the formula.

$$FSO_2CF_2CF_2OCF(CF_3)CF_2OCF{=}CF_2$$

This material, named as perfluoro [2-(2-fluorosulfonylethoxy)propyl]-vinyl ether, may be modified to equivalent monomers, as by modifying the internal perfluorosulfonylethoxy moiety to the corresponding propoxy moiety, and by altering the propyl group to ethyl or butyl group, and by rearranging the positions of substitution of the sulfonyl group thereon and by utilizing the perfluoro lower alkyl groups respectively.

The method of manufacture of the fluorosulfonyl copolymer is described in Example XVII of the above referred to U.S. Pat. No. 3,282,875 and an alternate method is disclosed in Canadian Pat. No. 849,670, which also discloses the use of these and analogous membranes in fuel cells, characterized therein as electrochemical cells. The disclosures of such patents are hereby incorporated herein by reference. In short, the copolymer can be made by reacting fluorosulfonated perfluorovinyl ether or the equivalent with tetrafluoroethylene or equivalent in the desired proportions in water at elevated temperatures and pressures for over an hour after which time the reaction mass is cooled. The mixture separates into a lower perfluoroether layer and an upper layer of an aqueous dispersion of the desired polymer. The molecular weight of the latter is indeterminate but the equivalent weight is from about 900 to about 1600, preferably from about 1100 to about 1400, and the percentage of the fluorosulfonated perfluorovinyl ether or corresponding compound is about 10 to 30 percent by weight, preferably about 15 to 20 percent by weight and most preferably about 17 percent by weight. The unhydrolyzed copolymer may be compression molded at high temperatures and pressures to produce sheets or membranes which may vary in thickness from about 0.002 to 0.5 mm. These then may be further treated to hydrolyze the pendant $-SO_2F$ to $-SO_3H$ groups as by boiling in water or in 10 percent aqueous sulfuric acid or by the methods of the patents previously mentioned. The presence of the $-SO_3H$ groups may be verified by titration with standard base as described in the Canadian patent previously mentioned. Additional details of various processing steps are described in Canadian Pat. No. 752,427 and U.S. Pat. No. 3,041,317, also hereby incorporated by reference.

As discussed above, because it has been found that some expansion or swelling accompanies the hydrolysis of the copolymer, it is advantageous to position the copolymer membrane into a frame or other support means to hold it in place on the surface of the electrode in the electrochemical cell. Thereafter it may be clamped or cemented in place on the electrode and will be true without sags or gaps. The membrane material is preferably joined to the backing material, e.g., tetrafluoroethylene or other suitable filamentary material prior to hydrolysis when the copolymer is still thermoplastic and the film of copolymer desirably covers each filament penetrating into the spaces or interstices of the backing material between them and even around behind them, thinning the films slightly in the process where it covers the filaments.

The cation-active permselective membrane material described above is far superior when assembled in the electrochemical cell as described herein to previously suggested materials. The new material is more stable at elevated temperatures, e.g., above 75° C. It lasts for much longer periods in the medium of the electrolyte and does not become brittle when exposed to chlorine at high cell temperatures. Moreover when assembled on the face of the electrode elements of the cell as described herein, the permissable gap between the electrodes can be substantially reduced and maintained constant resulting in increased power efficiency. Such an arrangement of the membrane material on the surface of the electrodes is disclosed and claimed in copending U.S. application Ser. No. 416,916 filed Nov. 19, 1973 now abandoned. Considering the savings in time, maintenance, and fabrication costs, these membranes are more economical. The voltage drop through the membranes is acceptable, does not vary due to the formation of gaps and sagging and does not become inordinately high as it does with many other membrane materials, when the caustic concentration in the cathode compartment increases to above about 200 g/l. The selectivity of the membrane and its compatability with the electrolyte does not decrease as the hydroxyl concentration of the catholyte liquor increases, as has been noted with other membrane materials, nor does the caustic efficiency of the electrolysis diminish as significantly as it does with other membranes as the electrolysis proceeds. Thus these improvements in the present membranes and the manner of emplacement thereof in the cell make it more practicable whereas previously disclosed ion-exchange membrane materials have not attained commercial acceptance. While the more preferred copolymers are those having equivalent weights of from about 900 to about 1600, with about 1100 to about 1400 being especially preferred, some useful resinous membranes of this same genre have equivalent weights within the range of about 500 to 4000. The intermediate equivalent weight copolymers are preferred because they are of satisfactory strength, stability, permselectivity, enable better selective ion exchange to take place and are of lower internal resistance, all of which are important in the electrochemical art.

Improved versions of the above-described copolymers may be made by chemical treatment of the surfaces thereof, as by treatments to modify the $—SO_3H$ groups thereon. For example, the sulfonic acid groups may be altered or replaced in whole or in part with other moieties. Such changes may be made in the copolymer manufacturing process or after production of the membrane. When effected as a subsequent treatment of the membrane, the depth of the treatment will usually be from 0.001 to 0.01 mm. Caustic efficiencies of the improved processes using such modified versions of the present improved membranes can increase about 3 to about 20% or more.

In addition to the copolymers discussed above, including modifications thereof, it has been found that another membrane material is also superior to prior art film for applications in electrochemical cells. Although it appears that tetrafluoroethylene polymers which are sequentially styrenated and sulfonated are not useful for making satisfactory cation-active permselective membranes acceptable for use in electrochemical processes, it has been found that perfluorinated ethylene propylene polymer which has been styrenated and sulfonated does make a useful cation-active permselective membrane material. Whereas useful lives of as much as three years or more (that of the preferred copolymer material) may not be obtained with this alternate material, it is surprisingly resistant to hardening under normal use conditions.

To manufacture the sulfostyrenated perfluorinated ethylene propylene polymers, a commercially available perfluoroethylene propylene polymer is styrenated and then the styrenated product is sulfonated. A solution of styrene in methylene chloride, benzene, or analogous solvent at a suitable concentration in the range of about 10 to about 20 percent by weight is prepared and a sheet of the polymer having a thickness of about 0.02 to 0.5 mm, preferably 0.05 to 0.15 mm, is immersed in the solution. After removal, the sheet is subjected to a radiation treatment, using a cobalt 60 radiation source. The rate of application may be in the range of about 8000 rads/hr. and a total radiation application should be about 0.9 megarads. After rinsing the irradiated sheet with water, the phenyl nuclei of the styrene portion of the polymer are monosulfonated, perferably in the para position, by treatment with chlorosulfonic acid, fuming sulfuric acid (oleum) or sulfur trioxide. Preferably chlorosulfonic acid in chloroform is used and the sulfonation may be completed in about ½ hour at ambient temperature.

Examples of such useful membranes made by the above described process are products of RAI Research Corporation, Hauppauge, N.Y., and are identified as 18ST12S and 16ST13S, the former being 18% styrenated and having about ⅔ of the phenyl nuclei monosulfonated and the latter being 16% styrenated having 13/16 of the phenyl nuclei monosulfonated. To obtain 18% styrenation, a solution of 17½% styrene in methylene chloride is utilized and to obtain a 16% styrenation, a 16% styrene solution in methylene chloride is employed.

The products resulting from this process compare favorably with the preferred copolymers previously described giving voltage drops of about 0.2 volt each in a typical electrochemical cell at a current density of 2 amperes/sq. in., about the same as is obtained with the preferred copolymer.

When sodium chloride solutions are electrolyzed in this cell employing the diaphragm described, which is substantially impervious to liquids and gases and has a structure such that it operates as a solid ionized salt, said structure being maintained rigid by the charged network of negative ions or aggregates of negative ions electrically balanced by a number of positive ions which are free to move in and through the structure, i.e., a cation-active diaphragm, it is evident that when the cathode compartment is initially charged with water or dilute aqueous sodium hydroxide, the anode compartment being charged with sodium chloride solution, chloride ions will be attracted to the anode and discharged thereat. Sodium ions will pass through the diaphragm whereas chloride ions and sodium chloride will be substantially barred by the impervious diaphragm from entering into the cathode compartment. Since essentially only sodium ions pass through the diaphragm and are discharged at the cathode, essentially salt free sodium hydroxide is produced in the cathode compartment. Similarly, when employing the cation active diaphragm in accordance with this invention, hydroxyl ions are effectively prevented from migrating from the cathode compartment through the diaphragm into the anode compartment. The current will therefore be carried substantially exclusively by the sodium ions from the anode to the cathode and the difficulties caused by the back migration of the hydroxyl ions are substantially eliminated by the process of this invention.

The new cell results in the advantages of low voltage drop in the cell, production of highly pure, i.e., essentially salt free, caustic soda, operation of the cell at relatively low cell voltage, high current efficiency and, especially at low caustic concentrations in the catholyte liquor, in high caustic efficiency. Moreover, because of the compatibility of the new permselective membrane in both chlorine and caustic alkaline environments at elevated temperatures, e.g., about 80 to 110 degrees centigrade, the membranes can be maintained in continuous service for extended periods, surprisingly longer than the permselective membranes of the prior art.

The diaphragms useful in the practice of the present invention can advantageously be prepared and utilized in the form of a thin film, either as such or deposited on an inert support, such as a cloth woven of Teflon® or glass fibers. The thickness of the supported membrane can be varied over a considerable range for example, from about 5 to 15 mils in thickness.

A wet 10 mil thick membrane of the character disclosed herein exhibits an electrolytic resistivity such that when inserted in an operating chlor alkali cell with a 0.25 inch gap between the anode and cathode, the voltage will increase only from about 0.5 to about 0.7 volts per ampere square inch in the range of 0.5 to 3 amperes per square inch.

The diaphragm can be fabricated in any desired shape. As generally prepared the preferred co-polymer membrane material is obtained in the form of the sulfonyl fluoride. In this non-acid form the polymer is relatively soft and pliable, and can be seam-or-butt-welded forming welds which are as strong as the membrane material itself. It is preferred that the polymeric material be shaped and formed in the non-acid state. Following shaping or forming into the desired membrane configuration, the material is conditioned for use by hydrolyzing the sulfonyl fluoride groups to free sulfonic acid or sodium sulfonate groups by boiling in water or caustic alkaline solutions. On boiling in water for about 16 hours, the conditioned membrane material undergoes swelling, about 28 percent, which is isotropic, about 9 percent in each direction. When exposed to brine, the swelling is reduced to about 22 percent which results in a net tightening of the membrane in use. The conditioning process can be carried out either out of the cell or with the diaphragm in place of the cell.

It has been found by another that the caustic efficiency of processes involving the use of a permselective membrane material can be increased by sandwiching together two membranes of this copolymeric material and inserting the sandwich between the anode and cathode. It has been noted that the caustic efficiency in the chlor-alkali cell having a single membrane diaphragm has a tendency to decrease as the caustic concentration of the catholyte liquor increases above about 100 gpl NaOH. By utilizing a sandwich of two or more membranes as the diaphragm, the caustic efficiency of the electrolysis process can be maintained at a high level at caustic concentrations of 250 gpl and above. Utilizing this technique various combinations of porous and permselective materials can be used to provide diaphragms which can be operated to provide high caustic efficiencies over a broad range of caustic concentrations in the catholyte compartment. Electrolytic methods and apparatus comprising such sandwich membranes are disclosed and claimed in U.S. application of F. Falvo, Ser. No. 335,975, filed Feb. 26, 1973.

The co-polymeric membrane material after conversion to the free acid or alkali metal salt state is subject to pin holing and tearing in use or on handling. It has been found that co-polymeric material of low equivalent weight, for example about 900 to 1000, is soluble in lower hydrocarbon alkanols, such as methanol, ethanol, isopropanol and the like. Such solutions, which may contain up to about 25 percent by weight of the solute, have been found to be excellent adhesives for the higher equivalent weight co-polymers, and consequently can be used to patch or repair damaged (i.e., pin holed or torn) membranes. Thus the damaged surface of the membrane can be wetted, i.e., coated or painted, with a solution of the lower equivalent weight co-polymer and covered with a patch of higher equivalent weight co-polymer the surface of which is preferably wetted with adhesive solution and pressed against the damaged area. The patch after drying or otherwise treated to remove the alcoholic solvent adheres to the surface forming a contiguous adherent area which is substantially impervious to the same degree as the original material.

In another embodiment of the present invention, the electrolytic cell, comprises a cell body having an anode compartment containing a cathode and at least one buffer compartment between said anode and cathode compartments, wherein the compartments are separated from each other by the permselective membrane of this invention. The cell body or container is formed into at least one set or unit of compartments made up of an anode compartment, containing the anode, a cathode compartment, containing the cathode, and at least one buffer compartment between the anode and cathode compartments. Typically, the electrolytic cell will contain a plurality of these sets, e.g., 20 to 30 or more, depending upon the size of the cell. These compartments are separated from each other by the membrane composed essentially of a hydrolyzed copolymer of a perfluorinated hydrocarbon and a fluorosulfonated perfluorovinyl ether. Alternatively, this membrane can be used to separate the anode compartment from the adjacent buffer compartment while the remaining compartments can be separated with conventional membranes since high chloride ion concentration is largely limited to the anode compartment. This permits the use of conventional membranes in this type of electrolysis cell for periods much longer than obtainable with presently available cells.

The anode compartment of each set or unit of compartments is formed with an inlet for introducing a liquid electrolyte into the compartment, such as an aqueous alkali metal halide brine and an outlet for gaseous reaction products, such as chlorine. The cathode compartment of each set or unit is formed with an outlet for liquid reaction products, such as aqueous solutions of alkali metal hydroxide, and also an outlet for gaseous by-products, such as hydrogen. If desired, the cathode compartment may also be formed with an inlet for a liquid electrolyte, such as water, dilute alkali metal hydroxide solutions, or the like. Additionally, each of the buffer compartments between the anode and cathode compartments is formed with an inlet for liquid electrolytes, such as water and, if desired may also have an outlet for liquid reaction products, such as dilute alkali metal hydroxide solutions. Preferably, the inlets for liquid materials and the outlets for gaseous products in each of the compartments are located in the upper portion of the compartment while the outlets for liquid materials are positioned in the lower portion of the compartments, although other locations may also be used.

These repeating sets or units of anode, buffer, and cathode compartments may be formed into the total electrolytic cell of the present invention in any convenient manner. Thus, in a preferred embodiment, the cell is of the so-called "filter press" type. In this embodiment, the anodes, cathodes, and membranes are mounted in suitable mounting or frame members which are provided with suitable sealing gaskets and are formed so as to provide the desired spacing between the elements to form the anode, cathode and buffer compartments. These frame members are provided with the desired inlets and outlets, as have been described and are secured together by tie rods, bolts, or other suitable means as in known in the art. Typical of such a filter press configuration is that shown in U.S. Pat. No. 2,282,058.

Alternatively, the cell body may be in the form of a box of a suitable material of construction in which anode, cathode and membrane are mounted to form the various compartments, such as that shown in U.S. Pat. No. 3,324,023. Additionally, the cell may be of the "conventional" chlor-alkali type having interleaved anodes and cathodes, wherein the deposited asbestos diaphragm is replaced with the various membranes as have been described, to form the desired buffer compartments. Typical of such a cell structure is that shown in U.S. Pat. No. 3,458,411.

In a three compartment cell, i.e., a cell having one or more repeating units of an anode compartment and a cathode compartment separated by a single center or buffer compartment, water is introduced into the center or buffer compartment and a dilute solution of sodium hydroxide is removed from this compartment. Generally, this solution will have a sodium hydroxide content of from about 50 to 200 grams per liter with a sodium hydroxide content of about 100 grams per liter being typical, Preferably, this dilute solution of sodium hydroxide is introduced into the cathode compartment, either with or without additional water, to form the catholyte liquor. From the cathode compartment there is obtained a more concentrated sodium hydroxide solution, having NaOH concentration of from about 150 to 250 grams per liter, with the sodium hydroxide content of about 160 per liter being typical. Additionally, gaseous products of chlorine gas and hydrogen gas are obtained from the anode compartment and the cathode compartment, respectively.

In an alternative method of operation, water is added to both the center or buffer compartment and to the cathode compartment and there is recovered from the buffer compartment a product stream of dilute sodium hydroxide and, from the cathode compartment, a product stream of more concentrated sodium hydroxide solution. When operating in this manner, the amount of dilute caustic soda solution recovered from the buffer compartment may be varied, depending upon the particular requirements for each type of solution. In a typical operation, approximately 50% of the sodium hydroxide will be recovered as a dilute solution from the buffer compartment with the other 50% being recovered as the more concentrated solution from the cathode compartment. The concentration of the dilute caustic soda solution will generally be within the range of about 50 to 200 grams per liter with a concentration of about 100 grams per liter being typical. Similarly, the concentration of the more concentrated caustic solution from the cathode compartment will generally be within the range of about 200 to 420 grams per liter with a concentration of about 280 grams per liter being typical.

Where the process is carried out with cells having sections or repeating units which contain two or more buffer compartments, water may be introduced into each of the buffer compartments and into the cathode compartment and a portion of the sodium hydroxide product values may be recovered from each of the buffer compartments, as a dilute solution of sodium hydride and from the cathode compartment as a more concentrated sodium hydroxide solution. Preferably, however, the dilute sodium hydroxide solutions from each buffer compartment is introduced as at least a portion of the feed to the next succeeding buffer compartment, and ultimately into the cathode compartment so that there is obtained from the cathode compartment a concentrated sodium hydroxide product stream of high purity.

The following examples illustrate certain preferred embodiments of the present invention. Parts and percentages are by weight and temperatures are given in degrees centigrade unless otherwise indicated.

EXAMPLE I

A saturated solution of sodium chloride brine was continuously introduced into the anode compartment of a two compartment electrolytic cell as illustrated in the drawing and containing a ruthenium oxide coated titanium mesh anode and a steel mesh cathode separated from the anode by a cationactive permselective diaphragm of 2.14 sq. in. effective area composed of a 10 mil thick film of a hydrolyzed co-polymer of a copolymer of tetrafluoroethylene and sulfonated perfluorovinylether of equivalent weight of about 1100, prepared according to U.S. Pat. No. 3,282,875 and conditioned to the free acid form by soaking in boiling water for about 16 hours.

The brine was circulated continuously with the anode compartment through a conduit in communication with the brine inlet and outlet. The cathode compartment was initially filled with dilute aqueous sodium hydroxide containing 50 gpl NaOH. Chlorine gas discharged at the anode was taken off from the anode compartment through the gas vent pipe and hydrogen discharged at the cathode was similarly vented from the cathode compartment. A cell temperature of about 90 degrees was maintained in the cell which was operated at a current density of about one ampere per square inch of diaphragm. At certain intervals in the operation of the cell, the current density was increased, as indicated in the following Table, to determine the effect on cell voltage in these instances. Samples of the catholyte liquor were taken at 24 hour intervals and analyzed for sodium hydroxide and sodium chloride concentration. The data from this run are set out in the following Table I.

TABLE I

| TIME | | DIAPHRAGM CURRENT DENSITY | VOLTAGE | CATHOLYTE CONTENT | |
|---|---|---|---|---|---|
| hrs | Days | amp/sq. in. | | gpl NaOH | gpl NaCl |
| 24 | 1 | 0.7 | 2.64 | 132.8 | 4.8 |
| 48 | 2 | 0.7 | 2.66 | 200.8 | 9.9 |
| 72 | 3 | 1.0 | 2.77 | 260 | 11.9 |
| | | 2.0 | 3.08 | 260 | 11.9 |
| | | 3.0 | 3.37 | 260 | 11.9 |
| 96 | 4 | 1.0 | 2.84 | 318 | 15.1 |
| 120 | 5 | 1.0 | 2.85 | 358 | 14.5 |
| 192 | 8 | 1.0 | 2.85 | 394 | 15.8 |
| 216 | 9 | 1.0 | 2.95 | 420 | 14.8 |
| 240 | 10 | 1.0 | 2.95 | 472 | 16.0 |
| | | 2.0 | 3.37 | 472 | 16.0 |
| | | 3.0 | 3.74 | 472 | 16.0 |
| 264 | 11 | 1.0 | 2.96 | 448 | 12.0 |

These data indicate the excellent ion selectivity and chemical compatibility of the permselective membrane diaphragm of this invention. Water transport through the membrane evidently restricts the build up of caustic concentration to allow 500 gpl.

EXAMPLE 2

A cell of similar design as used in Example 1 was operated for three days using 20 percent hydrochloric acid as the anolyte feed and 5 percent hydrochloric acid for the catholyte. The cathode in this instance was formed of graphite. The cell voltage at 1, 2 and 3 amperes per square inch varied from 2.14, 2.34 and 2.59 volts respectively at 78 degrees. The anode efficiency was 99 percent. No chlorine was detected in the cathode product and no hydrogen could be detected in the anode product.

What is claimed is:

1. An electrolysis cell comprising a housing, an anode, a cathode, a diaphragm member consisting essentially of a cationactive permselective membrane substantially impervious to liquids and gases, said diaphragm member consisting essentially of a sulfostyrenated perfluoroethylene propylene polymer, said diaphragm member separating said anode and said cathode thereby forming an anode compartment and a cathode compartment, said anode compartment having outlet means for the removal of gaseous products formed at the anode, inlet means for introducing an acidified, saturated alkali metal chloride brine into said anode compartment, a second outlet means for removing depleted brine from said anode compartment and brine replenishing means in communication with both said inlet means and said second outlet means, such that depleted brine is removed from the anode compartment through said second outlet means, passed through said replenishing means wherein it is resaturated and acidified and reintroduced into the anode compartment through said inlet means, and said cathode compartment containing a liquid inlet, a liquid outlet and an outlet for the gaseous products formed at the cathode.

2. The electrolysis cell as described in claim 1 wherein said sulfostyrenated perfluoroethylene propylene polymer is obtained by contacting a perfluoroethylene propylene polymer in an organic solvent solution of styrene, irradiating said polymer after contacting it with said styrene solution by exposing it to a cobalt 60 radiation source, rinsing the irradiated product with water and thereafter sulfonating said irradiated polymer by treating it with sulfonating agent selected from the group consisting of chlorosulfonic acid, oleum or sulfur trioxide.

3. The electrolysis cell as described in claim 2 wherein said sulfostyrenated perfluoroethylene propylene polymer is about 18 percent styrenated and has about $\frac{2}{3}$ of the phenyl groups monosulfonated.

4. The electrolysis cell as described in claim 2 wherein said sulfostyrenated perfluoroethylene propylene polymer is about 16 percent by weight styrenated and has about 13/16 of the phenyl groups monosulfonated.

* * * * *